US008287235B2

(12) United States Patent
Orban et al.

(10) Patent No.: US 8,287,235 B2
(45) Date of Patent: Oct. 16, 2012

(54) ELECTRICAL SUBMERSIBLE PUMP

(75) Inventors: Jacques Orban, Moscow (RU); Mikhail Gotlib, Moscow (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 1196 days.

(21) Appl. No.: 11/927,766

(22) Filed: Oct. 30, 2007

(65) Prior Publication Data

US 2008/0101924 A1 May 1, 2008

(30) Foreign Application Priority Data

Oct. 30, 2006 (RU) ..... 2006137966

(51) Int. Cl.
*F04D 29/54* (2006.01)

(52) U.S. Cl. ..... 415/199.2; 415/901

(58) Field of Classification Search ..... 415/55.5, 415/55.6, 198.1, 199.1, 199.2, 901, 903; 403/355, 359.1

See application file for complete search history.

(56) References Cited

U.S. PATENT DOCUMENTS

| | | | | |
|---|---|---|---|---|
| 2,544,266 | A | 3/1951 | Kennedy | |
| 3,265,001 | A * | 8/1966 | Deters | 415/68 |
| 3,653,116 | A | 4/1972 | Lov et al. | |
| 3,779,668 | A * | 12/1973 | Ekey | 415/199.3 |
| 3,878,802 | A | 4/1975 | Schmitt et al. | |
| 4,309,815 | A | 1/1982 | Schmitt et al. | |
| 4,781,531 | A * | 11/1988 | James | 415/199.1 |
| 4,909,705 | A * | 3/1990 | Katsura et al. | 415/170.1 |
| 4,961,260 | A * | 10/1990 | Ferri et al. | 29/888.025 |
| 5,425,618 | A * | 6/1995 | Janigro et al. | 415/199.1 |
| 5,722,812 | A * | 3/1998 | Knox et al. | 415/199.1 |
| 6,068,444 | A * | 5/2000 | Sheth | 415/199.2 |
| 6,074,166 | A * | 6/2000 | Moddemeijer | 415/109 |
| 7,575,413 | B2 * | 8/2009 | Semple et al. | 415/107 |
| 2005/0074331 | A1 * | 4/2005 | Watson | 415/199.2 |
| 2006/0024174 | A1 * | 2/2006 | Welch | 417/360 |
| 2006/0269404 | A1 * | 11/2006 | Volk | 415/198.1 |

FOREIGN PATENT DOCUMENTS

| | | |
|---|---|---|
| RU | 2015604 C1 | 6/1994 |
| RU | 2018716 | 8/1994 |
| RU | 2132000 | 6/1996 |
| RU | 2237961 C1 | 8/2005 |
| RU | 2259625 C1 | 8/2005 |
| SU | 1356121 A1 | 11/1987 |
| SU | 1723632 A1 | 3/1992 |
| SU | 1763719 | 9/1992 |

OTHER PUBLICATIONS

Russian Exam Report for corresponding Russian Application No. 2006137965/07 filed Oct. 30, 2006 dated Nov. 23, 2011.

* cited by examiner

*Primary Examiner* — Edward Look
*Assistant Examiner* — Aaron R Eastman
(74) *Attorney, Agent, or Firm* — Jim Patterson

(57) ABSTRACT

The invention relates to high-speed electrical submersible pumps used for hydrocarbons production from oil wells with high concentration of solids. The technical result such as a longer service life is achieved with the technical design, wherein the pump comprises: a housing with a head and a base, a compression nut, a shaft installed on a journal bearing, stages of impellers and spacers installed on the shaft, set of diffusers installed on the housing, wherein the diffusers and impellers are manufactured from a ceramic material. The preferable design has metal spacers between the diffusers, wherein the length of the diffuser spacer between the contact surfaces equals the distance between the impeller spacers.

19 Claims, 7 Drawing Sheets

A-A

ELECTRICAL SUBMERSIBLE PUMP

FIELD OF THE INVENTION

This invention relates to electrical submersible pumps (ESPs) of the type used for production of hydrocarbons from oil wells. In particular, the invention relates to high-speed pumps for use in wells that produce fluids with high concentration of solids.

BACKGROUND ART

ESP applications are typically defined as high-speed if the pump shaft is spinning the at a rate over 4500 RPM.

The average formation solids concentration in production flow from Russian wells is about 0.2 g/liter. In case of heavy oil production this parameter can be much higher. The concentration of proppant flowback in production flow can reach concentrations as high as 1 g/liter immediately after fracturing. A high rotational speed combined with high solids concentration in the production flow causes accelerated erosion wear of pump stages. Solids can be trapped inside small gaps between spinning and stationary components of a pump stage to produce abrasion in the stage material. As a result, the pump efficiency decreases. Stage wear also leads to an increase in dynamic loads for journal bearings. Accelerated wear of radial bearings may be a cause for premature pump failure. The theory of erosion teaches that erosive wear rate is proportional to the square of the velocity of the particles. For example, the pump rate growth from 3500 RPM to 7000 RPM will result in 4-times growth in the erosion wear rate of the stage. With current oil industry trends to increase production rates by operating of pumps at higher RPM, the erosion-protective elements became a vital feature for pump design.

RU 2,018,716 discloses a multistage centrifugal pump comprising a housing, guide vanes, shaft with impeller, intermediate spacers. A protective coating of wear-resistant material deposited, at least, in the places of shaft bending under the load exerted by intermediate bushings and guide vanes is disclosed. Protective coatings for opposite surfaces of guide vanes and spacers are made of superhard self-fluxing chrome-nickel alloy and/or superhard nickel-aluminum material.

The shortcoming of this design is a low resistance to abrasive impact by particles suspended in the fluid.

RU 2,132,000 discloses a multistage centrifugal pump comprising a housing, guiding apparatuses installed inside the housing through end and intermediate bearing supports, a shaft with an alternating arrangement of impellers and spacers. Each impeller has an annular support comprising a lower disk for delivering axial loads to the housing during pump operation. Each intermediate spacer is made from two ring U-like items telescopically mated to each other. These have holes in the base, so one U-shaped item is tightly fixed between the guiding apparatuses, and axial mobility of the other U-shaped item is provided by the size of the longitudinal groove in the immobile item and the peg matched to the groove of immobile item. The base of the item has two lugs, one is required for contact with the annular support of the impeller above, and the other lug is required for closure of the ring-like cavity created by the external cylindrical surface of the protective bushing and the inside wall of the immobile U-shaped item, and external side of the mobile U-shaped item. This ring-like cavity accommodates an elastic material, e.g., fluoroplastic or its composites.

The shortcoming of this pump is complex design and low stability to impact of abrasive particles suspended in the pumped fluid.

SU 1,763,719 discloses a multistage submersible centrifugal pump. This pump consists of a cylindrical housing with many stages. Each stage is installed on the shaft with axial freedom for the impeller (with hub) and the diffuser, that includes a vaned disk fixed to the housing with a central orifice and vanes on the end facing the impeller, and an external disk with a hub. At this point, the surfaces of the orifice of the vaned disk and the hub of the external disk produce an annular channel. At least part of diffusers are equipped with intermediary spacers forming the inside surfaces of the hubs. The diffusers with intermediary spacers are equipped with damping O-rings; they are equipped with windows and made from an elastic material; the rings are laid into the inlet annular channels.

The drawback of this pump is low resistance to abrasive particles suspended in the pumped fluid.

The object of this invention is to provide a new design of submersible pump which can potentially give a longer service life than the prior art designs.

SUMMARY OF THE INVENTION

The pump according to the invention comprises: a housing with a head and a base, a compression nut, a shaft installed on a journal bearing, stages comprising impellers and spacers installed on the shaft, and sets of diffusers installed on the housing, wherein the diffusers and impellers are manufactured from a ceramic material. The preferable design has metal spacers between the diffusers, wherein the length of the diffuser spacer between the contact surfaces equals the distance between the impeller spacers.

In a preferable embodiment, the diffuser spacer made as an element with rigidity in the axial direction but flexible for bending, the impeller spacer has a protrusion, and the ceramic impeller has a mating slot, and besides, has a rounded axis-directed slit that passes the whole inner diameter of the impeller. In the preferable embodiment, the protrusion of the impeller spacer has a flexibility enough to hold a torque. For longer service life of the submersible pump, the metal impeller spacer may be coated with an abrasive-resistant material. Two matching surfaces of stages are divided by a layer of damping material, usually an elastomer. A diffuser spring sleeve with high rigidity in the axial direction may be installed between the diffuser stack and the head. In this case another similar spring sleeve (with smaller size) is installed between the shaft nut and the impeller stack.

BRIEF DESCRIPTION OF THE DRAWINGS

The disclosed invention is illustrated by the following drawings

DETAILED DESCRIPTION

Figure 1:
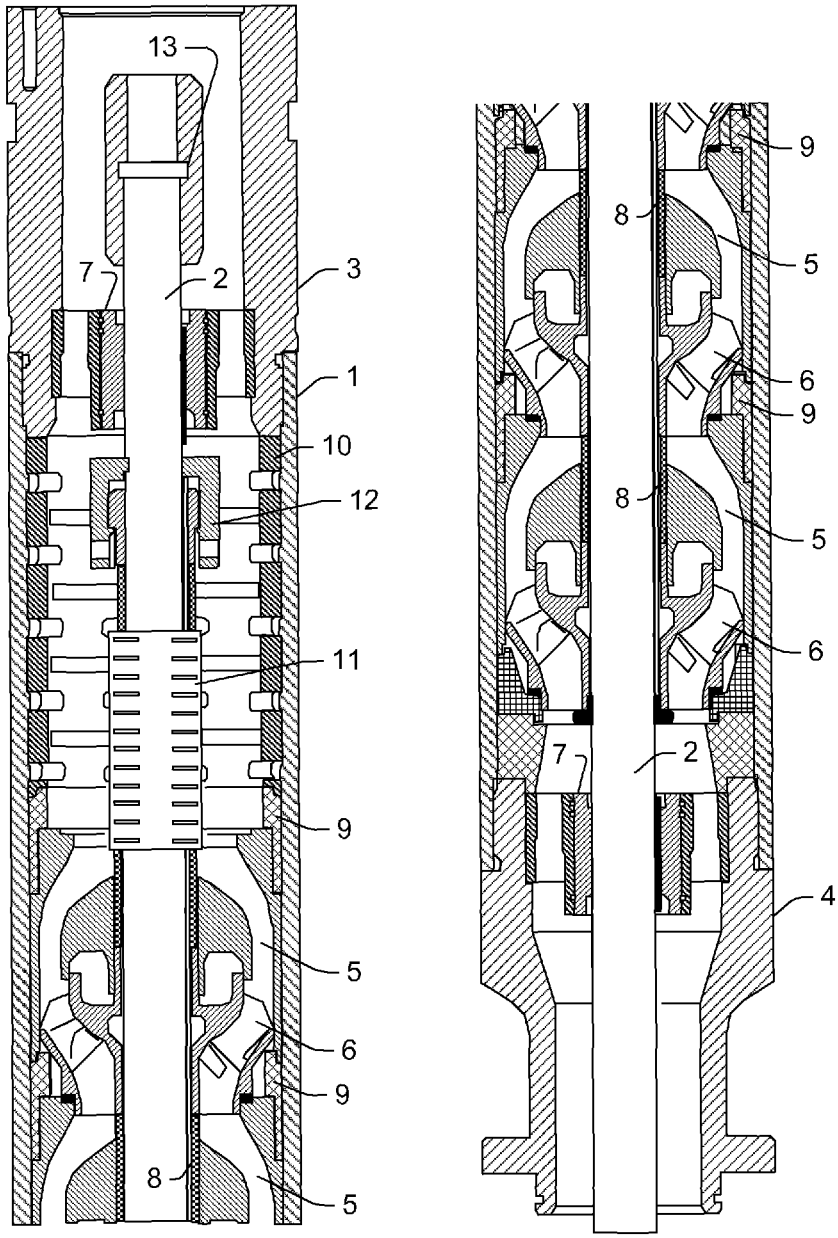
FIG. 1 shows a general view of the pump section.

The erosion-resistant pump section design according to an embodiment of the invention (see FIG. 1) comprises the following components: housing 1, shaft 2, head 3, base 4, diffusers 5, impellers 6, journal bearings 7, impeller spacers 8, diffuser spacers 9, diffuser spring sleeve 10, impeller spring sleeve 11, compression nut 12, and torque spline coupling 13.

The diffusers stack is compressed inside the housing 1 between the head 3 and the base 4. The compression force magnitude is several tons. The compression force required value is based on the criteria of elimination of gaps between contact surfaces and providing enough friction for preventing diffusers turning inside the housing. The impeller stack is compressed by means of nut 12 on shaft 2. For the impeller stack, the compression force magnitude requirement is much lower—only a few kilograms. A lower compression force in case of impeller stack is explained by the fact that there is a special torque transmission feature (explained below), constructed between the shaft and each impeller. Consequentially, the compression force for the impeller stack should be just sufficient enough to close the gaps between impeller and spacer contact surfaces.

Diffusers 5 and impellers 6 are formed entirely from ceramic material. Aluminum oxide ($Al_2O_3$) can be used as a ceramic material for fabrication of the stages. Aluminum oxide has excellent erosion resistant properties and will allow the pump stage to last for a long time in presence of production solids without pump head and efficiency deterioration.

Thermal expansion is one of the main issues to be addressed in the pump construction with monoblock ceramic stages. This issue is due to the fact that there is a significant difference in thermal expansion coefficients for steel and ceramic. The thermal expansion coefficient for aluminum oxide ceramics is approximately two and a half times less than for steel. If, for example, the pump section is exposed to downhole temperature +120° C. (typical for Russian fields), then two main problems will be encountered:

One problem is loss of compression force for the impeller and diffuser stack. For a pump section with the housing length of 6m assembled at room temperature +20° C., the new downhole temperature of +120° C. creates thermal a expansion resulting in length difference between housing (from carbon steel) and ceramic diffusers stack of about 4 mm. Obviously the diffuser stack compression force declines significantly and, depending on the initial stack compression force and housing elongation during assembly, the preloading force drops significantly (approximately by 70%) and the diffusers can become loose.

Another problem is loss of the gaps between diffuser and impeller stages. In a complete pump assembly including the electric motor and the protector, each impeller downthrust washer is barely touching the mating surface on the diffuser and equal upper gap is maintained between each impeller and diffuser (upthrust washer can be positioned either on impeller or diffuser dedicated surface/groove). The upper gap value for each stage is identical within tolerance limits and for most pumps this gap is maintained in the range of 1-1.5 mm. Even a slight difference in the overall length between diffusers and impellers stacks under the downhole temperature conditions causes elimination of the upper gap and growth of the lower gap for a significant number of stages. As a result, a pump assembly, even one that has been properly assembled and shimmed at the shop or surface conditions, can end up with a jammed impeller/diffuser stack under downhole conditions and the pump will be stalled.

Another important issue to be addressed in the design according to the invention is reduction and damping of bending and impact stresses in the ceramic stages. The ceramic material has high compressive strength but limited flexural strength and is sensitive to impact loads. Bending stresses will be induced in stages during pump handling/shipping operations. Impact loads will be generated when diffuser/impeller surfaces touch each other in overlapping areas with small gaps, and during rotation transmission from shaft to impellers.

The proposed pump construction eliminates the above described thermal expansion, bending, and impact load issues.

Figure 5:
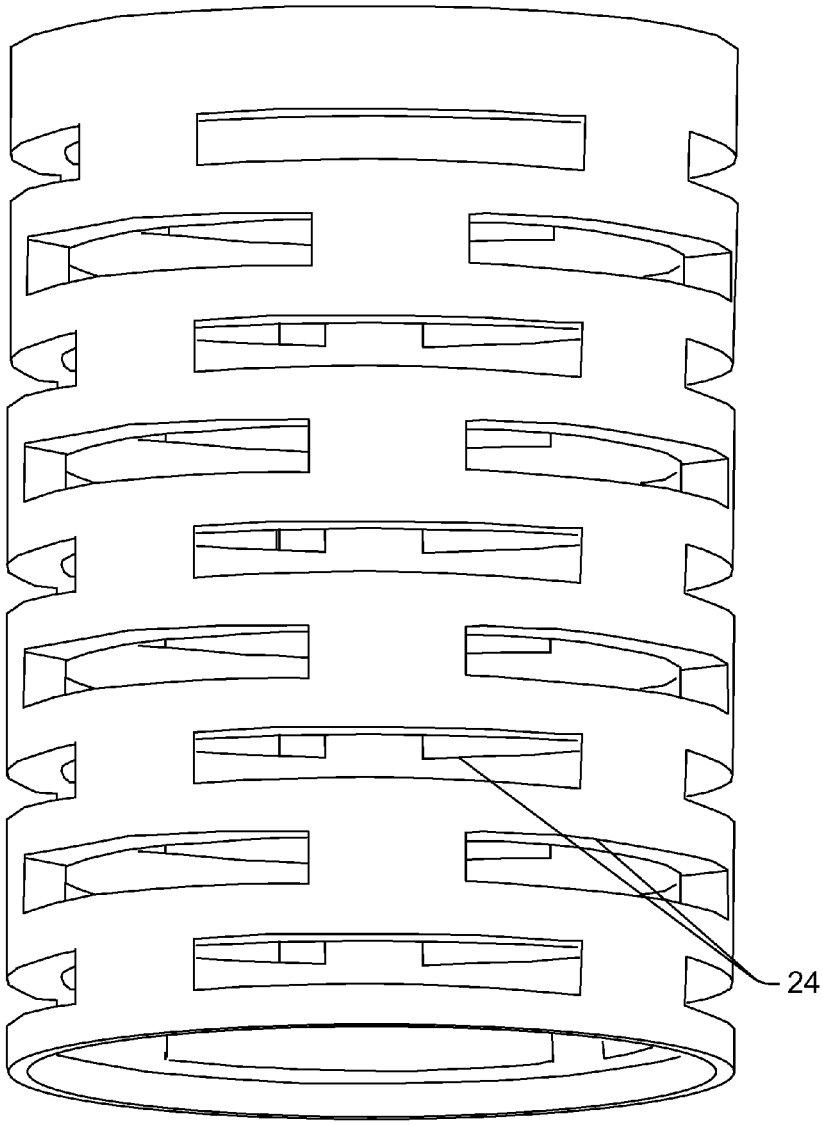
FIGS. 5 and 6 show the pump diffuser spring sleeve and the impeller spring sleeve.
Figure 6:
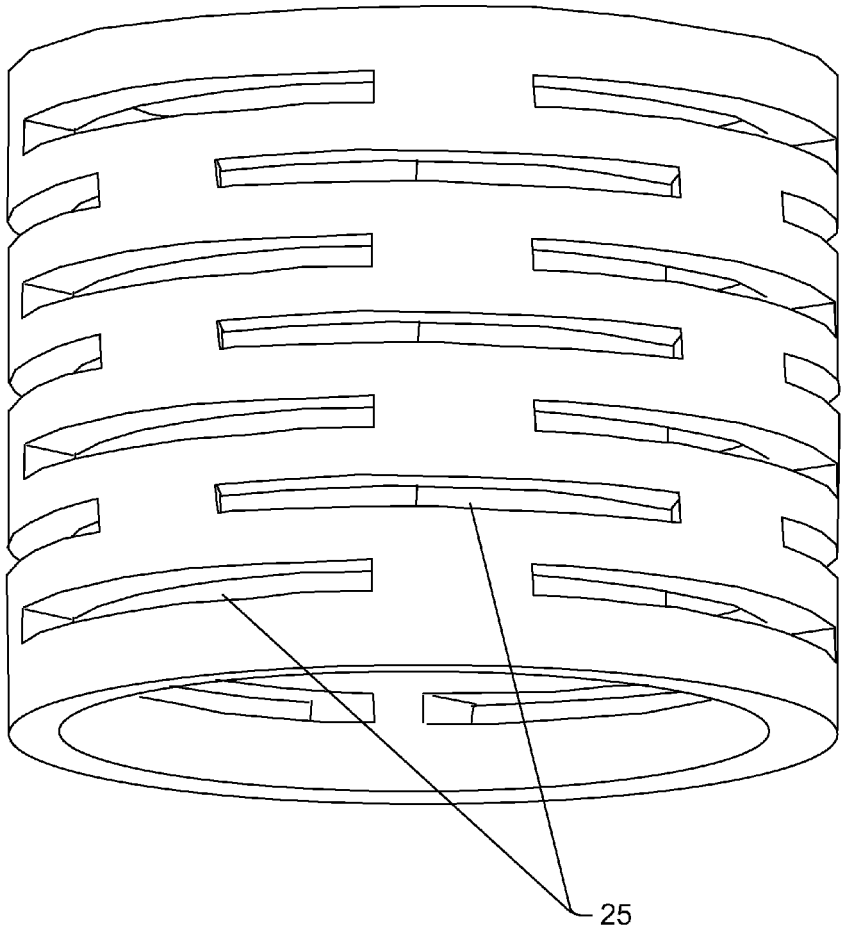

The thermal expansion issue is solved by means of a spring-type design of the spacer sleeves 10, 11 for the diffuser and impellers stacks shown in FIG.5 and FIG.6. The sleeves have tangential overlapping slots 24 and 25 arranged in a pattern shown in FIG. 5 and FIG. 6. A multiple slot arrangement converts this spacer sleeve into a spring with high stiffness (high ratio of compression force to deformation). In the proposed pump construction, the spring sleeve 10 is placed between the upper diffuser and pump head 3 (see FIG.1). The spring sleeve 11 is placed between the upper impeller and shaft nut 12 (see FIG.1). The proposed sleeve construction maintains a sufficient compression force for the impeller and diffuser stack and also handles the difference in thermal expansion of the shaft and the housing. An elastomer ring 17 (FIG.2) having a rectangular or round cross-section is placed in the groove at the outer surface of ceramic diffuser. The friction force, originated by contact of the elastomer ring, diffuser, and housing, helps in preventing the diffusers from turning inside the housing. This makes allowance for loss of friction torque between the diffuser faces due to thermal expansion.

The thermal expansion issue is solved by introducing a steel spacer 9 between diffusers 5 (see FIG. 2) with the length equal to the impeller spacer length: L(spacer diff)=L(spacer imp).

The proposed construction the temperature-induced extension is the same for stacks of diffusers and impellers. As a result, stages adjustment is not lost and stays the same regardless of the downhole temperature.

An important aspect of the proposed pump design is transmission of torque from the shaft 2 to the impellers 6. In conventional pump sections with cast iron stages a key-groove connection is used for torque transmission. A long rectangular-shaped key is retained in the shaft groove and each impeller bore has a matching slot. In case of an impeller formed entirely from ceramic, this design cannot work properly. Shock loads are transmitted though the metal key and destroy the ceramic material of the groove. The key size and the impeller hub dimensions prevent making a robust key-groove connection. In the disclosed design this issue is avoided by arranging another mechanism for torque transmission (see FIG.2 and FIG. 3). The torque from the shaft 2 is transmitted through a conventional rectangular-shaped key 15 to a steel impeller spacer 8. The torque from the spacer 8 is transmitted to the impeller 6 through a protrusion/slot connection. The impeller spacer protrusions 14 mate with slots 23 on the impeller hub face (FIG.4). The material thickness available through the connection ensures a robust torque connection between the steel and ceramic components. To dampen the impact of shock loads during torque transmission, the protrusions 14 have a flexible feature due to matching configurations 21 shown in FIG. 4.

Figure 3:
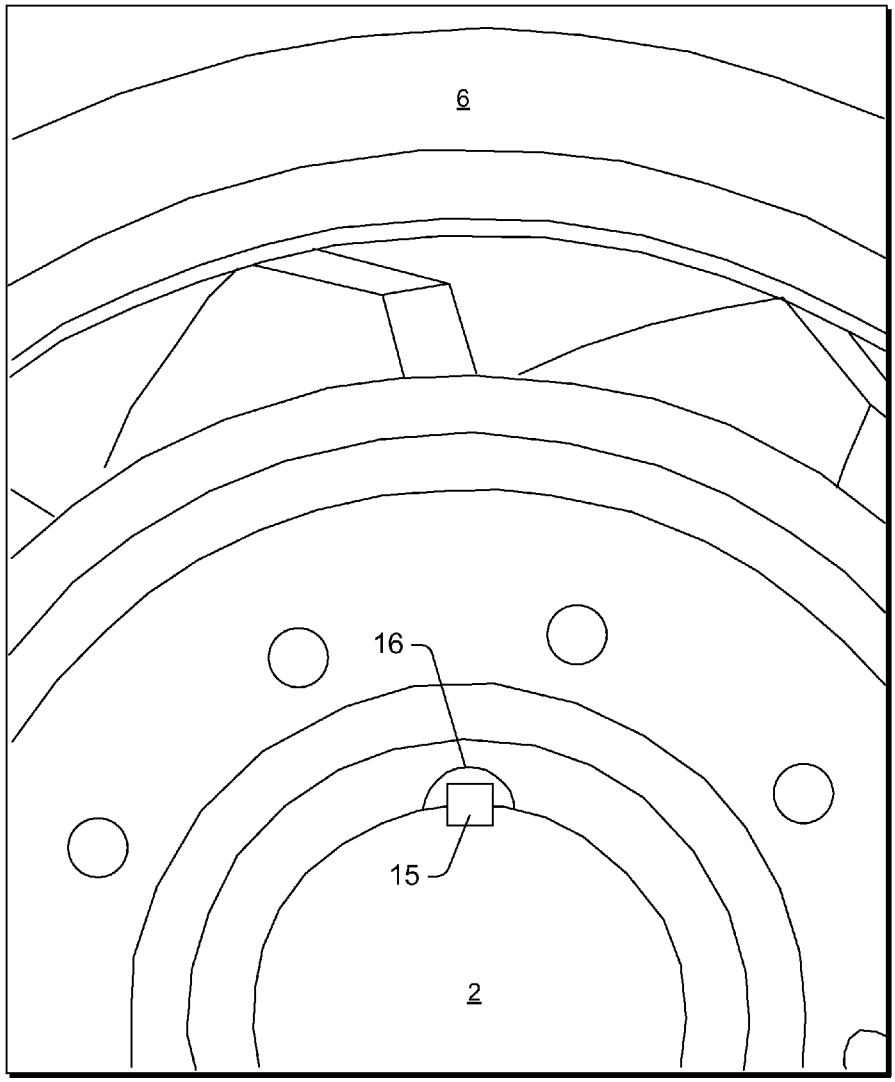
FIG. 3 shows a cross section on line A-A' of FIG. 2.
Figure 4:
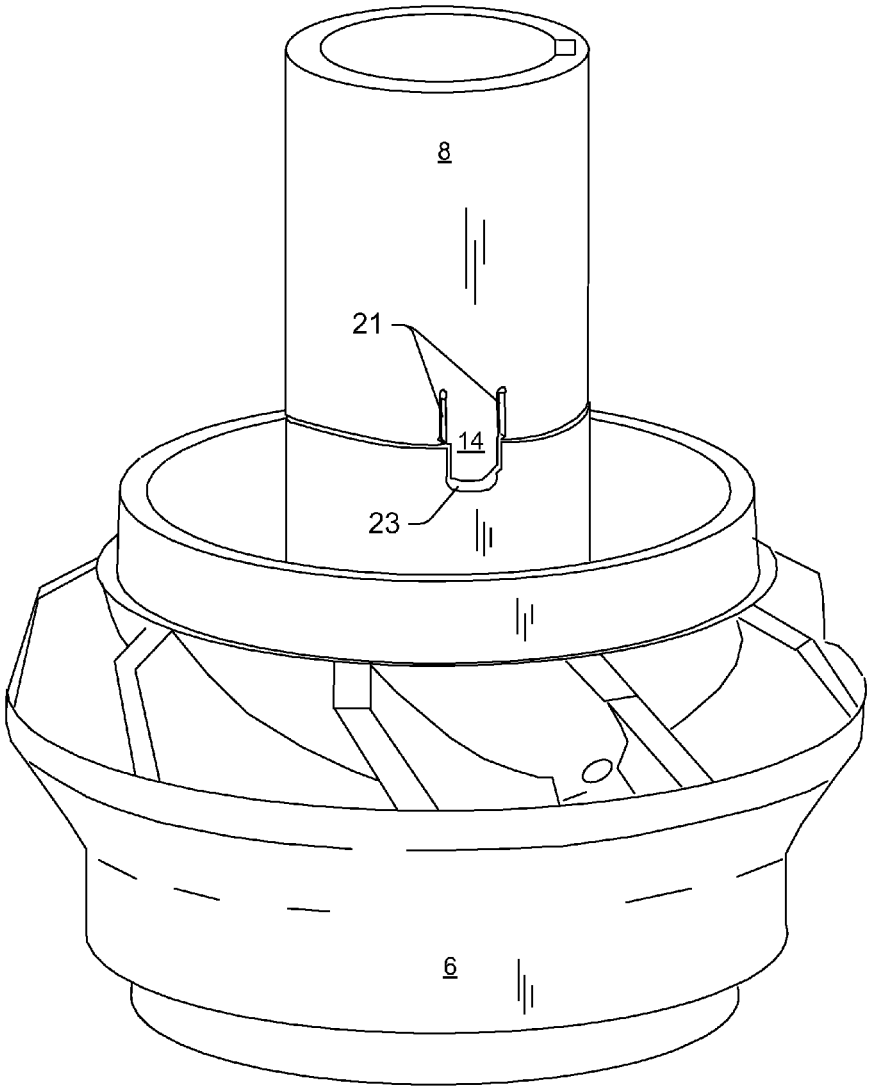
FIG. 4 shows the impeller spacer connection with the impeller.

To make the key allocation easy, the impeller inner surface has a rounded groove 16 (see FIG. 3).

Figure 2:
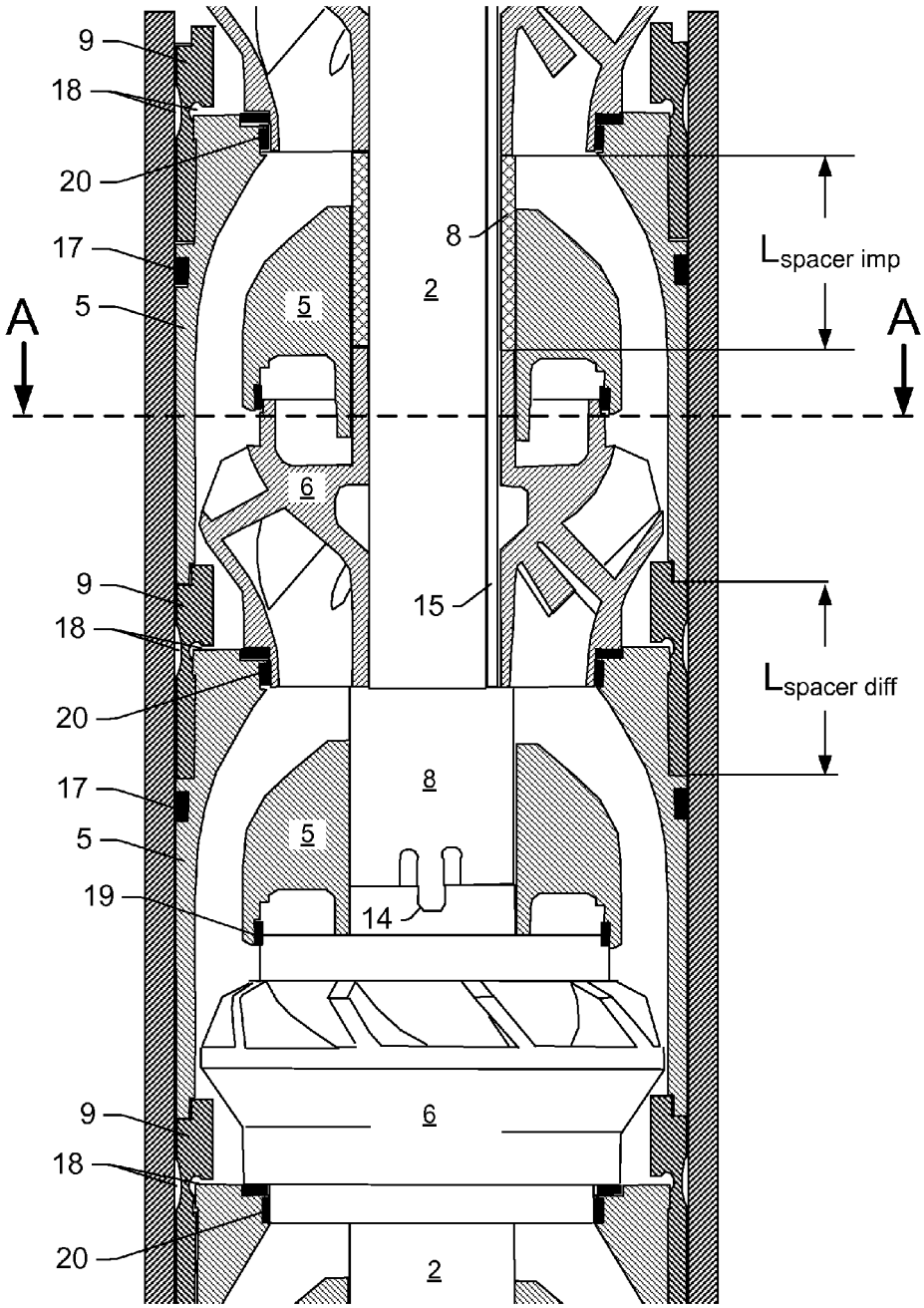
FIG. 2 shows detailed construction of the pump stage.
Figure 7:
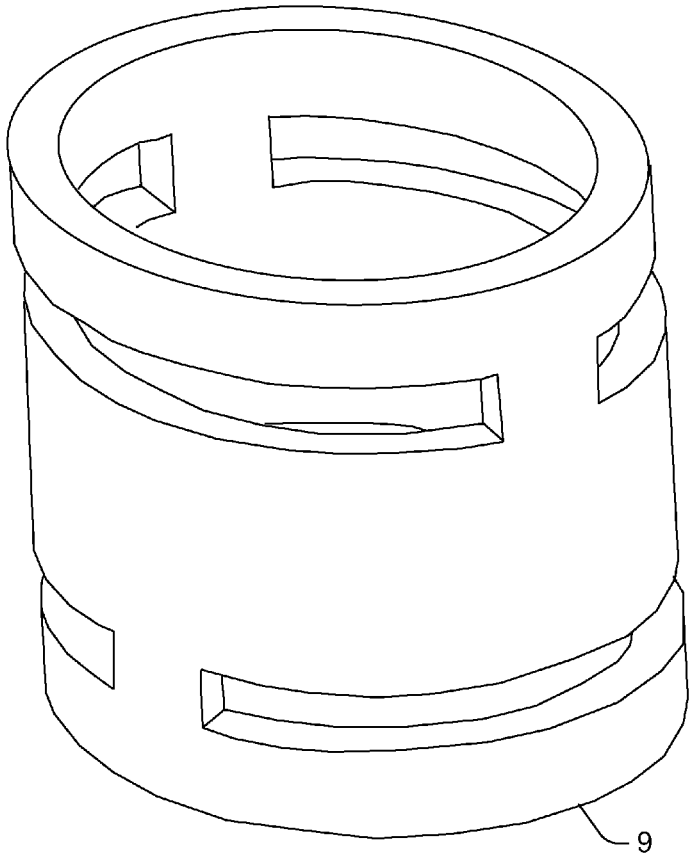
FIG. 7 shows one possible design for the diffuser spacer.

To protect the diffuser from bending loads, the spacer 9 is made stiff in the axial direction and flexible in transverse direction. In other words, a "hinge element" is placed between the diffusers. One design variant of the spacer is shown in FIG. 2. The spacer 9 (FIG. 2) has a machined piece with a reduced diameter. This design reduces the bending rigidity while keeping axial rigidity at the same level. Another version of a construction of the diffuser spacer is shown in FIG. 7. In preferred embodiment, the spacer is made from three rings: the central ring has a higher axial length to be rigid to support local axial loads at 90 degree locations. The two outer rings will typically have a slightly smaller axial extent. The outer rings are connected to the central ring only via two metal zones (uncuts) at 180 degrees from each other. It should also be noted that the metal zones of the top ring are at 90 degrees from the metal zones at the other ring. With such a design, the ring is extremely rigid in compression. But its two external face can be bent in any direction.

One of the ways of achieving this is also by placing undercuts 18 (FIG. 2) through the diffuser spacer middle area.

To prevent damage to the stage features from impact loads, elastomer layers 19 and 20 are placed on diffuser surfaces (FIG. 2).

The outside surface of the impeller spacer 8 is formed from abrasion resistant material. The surface layer can be formed from tungsten, silicon carbide, or by ceramic material. Each diffuser hub and impeller spacer pair also acts as a radial bearing with wear-proof surfaces.

The above described pump features allow construction of an erosion-resistant electrical submersible pump from monoblock ceramic stages.

The invention claimed is:

1. An electrical submersible pump, comprising;

a housing having a head and a base;

diffusers mounted in the housing;

diffuser spacers, each of the diffuser spacers installed between a respective pair of the diffusers;

a shaft installed in the housing on a journal bearing in the head and a journal bearing in the base;

ceramic impellers installed on the shaft wherein each ceramic impeller comprises a slot;

impeller spacers, each of the impeller spacers installed between a respective pair of the ceramic impellers, wherein each impeller spacer comprises a rounded slot that extends axially along a full length of an inner surface and a protrusion that mates with the slot of a respective one of the ceramic impellers for transmitting torque; and a compression nut mounted to the shaft to apply a compressive force to the ceramic impellers and the impeller spacers for eliminating gaps therebetween.

2. A pump as claimed in claim 1, wherein the diffuser spacers comprise metal diffuser spacers and wherein the impeller spacers comprise metal impeller spacers wherein metal diffuser spacer length equals metal impeller spacer length.

3. A pump as claimed in claim 1, wherein the diffuser spacers are constructed as sleeves that are axially rigid and flexible in bending.

4. A pump as claimed in claim 1, wherein the protrusion of each of the impeller spacers comprises a flexible protrusion for torsion load.

5. The pump of claim 1, wherein each of the impeller spacers comprises an metal impeller spacer that comprises an outside layer made from abrasion resistant material.

6. The pump of claim 1, wherein each of the diffusers comprises a ceramic diffuser that comprises a groove along an outer surface that receives an elastomer compound formed with a rectangular or circular cross-section.

7. The pump of claim 1, wherein a layer of a soft compound is placed between overlapping surfaces of a respective one of the diffuser and a respective one of the ceramic impellers.

8. The pump as in claim 7, wherein the soft compound comprises a polymeric elastomer.

9. The pump as in claim 1, wherein a sleeve rigid in an axial direction is placed between an uppermost one of the diffusers and the head and another sleeve rigid in an axial direction of smaller size is placed between the compression nut and an uppermost one of the ceramic impellers.

10. A pump as claimed in claim 1 further comprising a diffuser spring sleeve to bias the diffusers and the diffuser spacers between the head and the base of the housing.

11. A pump as claimed in claim 1 further comprising an impeller spring sleeve to bias the ceramic impellers and the impeller spacers on the shaft via the compressive force applied by the compression nut.

12. A pump as claimed in claim 1 wherein transmission of torque via the protrusions and the slots allows for a reduction in the compressive force applied by the compression nut.

13. A pump as claimed in claim 1 wherein the ceramic impellers comprise aluminum oxide.

14. A pump as claimed in claim 1 wherein each of the impeller spacers comprises a groove that extends axially along a full length of an inner surface for receipt of a key.

15. A pump as claimed in claim 1 further comprising an elastomer ring disposed between an outer surface of one of the diffusers and an inner surface of the housing to increase friction therebetween to help prevent rotation of at least the one of the diffusers in the housing.

16. A pump as claimed in claim 1 further comprising a diffuser spring sleeve and an impeller spring sleeve to accommodate a difference in thermal expansion of the shaft and the housing.

17. A pump as claimed in claim 1 wherein each of the diffuser spacers comprises at least one undercut.

18. A pump as claimed in claim 1 wherein each of the diffuser spacers comprises an undercut along an inner surface and an undercut along an outer surface.

19. A pump as claimed in claim 18 wherein the undercuts of each of the diffuser spacers provide for a reduced diffuser spacer wall width to reduce bending rigidity.

* * * * *